US011654683B2

(12) United States Patent
Kubota et al.

(10) Patent No.: US 11,654,683 B2
(45) Date of Patent: May 23, 2023

(54) HEAD CHIP, LIQUID JET HEAD, LIQUID JET RECORDING DEVICE, AND METHOD OF MANUFACTURING HEAD CHIP

(71) Applicant: SII PRINTEK INC., Chiba (JP)

(72) Inventors: Yuzuru Kubota, Chiba (JP); Satoshi Horiguchi, Chiba (JP); Tomoaki Hoshi, Chiba (JP)

(73) Assignee: SII PRINTEK INC, Chiba (JP)

( * ) Notice: Subject to any disclaimer, the term of this patent is extended or adjusted under 35 U.S.C. 154(b) by 52 days.

(21) Appl. No.: 17/523,605

(22) Filed: Nov. 10, 2021

(65) Prior Publication Data

US 2022/0161557 A1 May 26, 2022

(30) Foreign Application Priority Data

Nov. 20, 2020 (JP) ..... JP2020-193668
Jul. 14, 2021 (JP) ..... JP2021-116504

(51) Int. Cl.
*B41J 2/14* (2006.01)
*B41J 2/16* (2006.01)

(52) U.S. Cl.
CPC ..... *B41J 2/1433* (2013.01); *B41J 2/1623* (2013.01); *B41J 2002/14467* (2013.01)

(58) Field of Classification Search
CPC ..... B41J 2/1433; B41J 2/1623; B41J 2002/14467; B41J 2/1606; B41J 2/1609; B41J 2/1632; B41J 2/1635; B41J 2/1642; B41J 2002/14419; B41J 2/14209; B41J 2002/14362; B41J 2002/14491; B41J 2202/12; B41J 2/17546; B41J 2/01
See application file for complete search history.

(56) References Cited

U.S. PATENT DOCUMENTS

2017/0217178 A1 8/2017 Seki

FOREIGN PATENT DOCUMENTS

JP 2012-131175 A 7/2012
JP 2017-136724 A 8/2017

OTHER PUBLICATIONS

IP.com search (Year: 2023).*
Kameyama et al., "Head Chip Used In Liquid Jet Head, Has Common Electrodes Which Are Formed on Respective Inner Surfaces of Ejection Grooves, and Commonalization Interconnection Adapted to Electrically Connect Common Electrodes to Each Other", May 15, 2019, Paragraphs 0025-0071 (Year: 2019).*

* cited by examiner

*Primary Examiner* — Lisa Solomon
(74) *Attorney, Agent, or Firm* — Crowell & Moring LLP

(57) ABSTRACT

There are provided a head chip, a liquid jet head, a liquid jet recording device, and a method of manufacturing the head chip each capable of preventing the short circuit of electrodes by ink to maintain an excellent ejection performance over a long period of time. The head chip according to an aspect of the present disclosure includes an actuator plate, a cover plate, and an intermediate plate. In the actuator plate, open apertures which communicate an inside and an outside of a non-ejection channel with each other are formed in both end portions of the non-ejection channel in a Y direction. In the actuator plate, open apertures which communicate an inside and an outside of a non-ejection channel with each other are formed in both end portions of the non-ejection channel in the Y direction.

11 Claims, 12 Drawing Sheets

HEAD CHIP, LIQUID JET HEAD, LIQUID JET RECORDING DEVICE, AND METHOD OF MANUFACTURING HEAD CHIP

RELATED APPLICATIONS

This application claims priority to Japanese Patent Application No. 2021-116504, filed on Jul. 14, 2021, and Japanese Patent Application No. 2020-193668, filed on Nov. 20, 2020, the entire content of which is incorporated herein by reference.

BACKGROUND OF THE INVENTION

1. Field of the Invention

The present disclosure relates to a head chip, a liquid jet head, a liquid jet recording device, and a method of manufacturing a head chip.

2. Description of the Related Art

An inkjet head to be installed in an inkjet printer ejects ink to a recording target medium through a head chip installed in the inkjet head. The head chip is provided with an actuator plate in which ejection channels and non-ejection channels formed alternately, and a nozzle plate bonded to the actuator plate. In the actuator plate, electrodes are formed respectively on inner surfaces of the ejection channels and the non-ejection channels.

In the head chip, by the volume of an inside of the ejection channel changing due to a voltage applied to the electrode, the ink in the ejection channel is ejected through a nozzle hole provided to the nozzle plate.

For example, in JP-A-2012-131175 and JP-A-2017-136724, there is disclosed a configuration in which a protective film which covers the electrode and has an insulation property is formed on the inner surface of the ejection channel. According to this configuration, it is conceivable that it is possible to prevent the electrodes from shorting via the ink inside the ejection channel even when using conductive ink.

Incidentally, in the head chip, there is a possibility that the conductive ink inflows into the non-ejection channel from the inside of the ejection channel through a void in the actuator plate, a joint portion between the actuator plate and other members, and so on.

However, in the related-art configuration, room for improvement still exists in the point that the protective film is actively formed on the inner surface of the non-ejection channel. When the ink supposedly inflows into the non-ejection channel, there is a possibility that the electrodes formed on the inner surface of the non-ejection channel short via the ink.

SUMMARY OF THE INVENTION

The present disclosure provides a head chip, a liquid jet head, a liquid jet recording device, and a method of manufacturing the head chip each capable of preventing the short circuit of electrodes by ink to maintain an excellent ejection performance over a long period of time.

In view of the problem described above, the present disclosure adopts the following aspects.

(1) The head chip according to an aspect of the present disclosure includes an actuator plate having a first channel area and a second channel area disposed side by side in a first direction, a first jet channel extending in the first direction and a first non-jet channel extending in the first direction being arranged in a second direction crossing the first direction in the first channel area, and a second jet channel extending in the first direction and a second non-jet channel extending in the first direction being arranged in the second direction in the second channel area, a cover plate which has a first liquid flow channel communicated with the first jet channel, and a second liquid flow channel communicated with the second jet channel, and which is stacked on the actuator plate, and a communication plate which has a first communication hole communicated with the first jet channel in a central portion in the first direction, and a second communication hole communicated with the second jet channel in a central portion in the first direction, and which is stacked on the actuator plate at an opposite side to the cover plate, wherein protective films are formed respectively on an inner surface of the first jet channel, an inner surface of the first non-jet channel, an inner surface of the second jet channel, and an inner surface of the second non-jet channel, in the actuator plate, first open apertures which communicate an inside and an outside of the first non-jet channel with each other are formed in both end portions of the first non-jet channel in the first direction, and in the actuator plate, second open apertures which communicate an inside and an outside of the second non-jet channel with each other are formed in both end portions of the second non-jet channel in the first direction.

According to the present aspect, by introducing the formation material of the protective film into the first non-jet channel through the first open apertures formed in the both end portions of the first non-jet channel, it is possible to effectively form the protective film on the inner surface of the first non-jet channel. By introducing the formation material of the protective film into the second non-jet channel through the second open apertures formed in the both end portions of the second non-jet channel, it is possible to effectively form the protective film on the inner surface of the second non-jet channel.

As a result, it is possible to prevent the short circuit or the like of the electrodes formed on the inner surfaces of the non-jet channels caused by, for example, liquid having entered the non-jet channels.

(2) In the head chip according to (1) described above, it is preferable that the first open apertures include a first inside open aperture located in the end portion of the first non-jet channel at the second channel area side in the first direction, and a first outside open aperture located in the end portion of the first non-jet channel at an opposite side to the second channel area side in the first direction, the second open apertures include a second inside open aperture located in the end portion of the second non-jet channel at the first channel area side in the first direction, and a second outside open aperture located in the end portion of the second non-jet channel at an opposite side to the first channel area side in the first direction, and a common groove which extends in the second direction, and which is communicated with the first inside open apertures in a plurality of the first non-jet channels, and the second inside open apertures of a plurality of the second non-jet channels is formed in a boundary portion located between the first channel area and the second channel area in the first direction in the actuator plate and the communication plate.

According to the present aspect, the formation material of the protective film is introduced into the non-jet channels via the inside open apertures from the common groove. Thus, it is possible to efficiently form the protective films compared to when introducing the formation material of the protective films individually into the non-jet channels through the inside open apertures.

(3) In the head chip according to (2) described above, it is preferable that the cover plate is provided with a communication groove communicated with the common groove.

According to the present aspect, since it is possible to reduce the pressure loss in the space connected to the open apertures, it is possible to efficiently introduce the formation material of the protective film into the non-jet channels through the inside open apertures.

(4) In the head chip according to (3) described above, it is preferable that the communication groove is made larger in width in the first direction than the common groove, and the communication groove is communicated with the first inside open aperture and the second inside open aperture from an opposite side to the communication plate with respect to the actuator plate.

According to the present aspect, the formation material of the protective film having entered the communication groove through the common groove is introduced into the non-jet channels through the inside open apertures from the opposite side to the communication plate with respect to the actuator plate. Thus, the formation material of the protective films is introduced into the non-ejection channels directly through the common groove or indirectly through the communication groove. As a result, it is possible to efficiently form the protective films on the inner surfaces of the non-jet channels.

(5) In the head chip according to (3) or (4) described above, it is preferable that the cover plate includes a first common flow channel communicated with a plurality of the first liquid flow channels in a lump, and a second common flow channel communicated with a plurality of the second liquid flow channels in a lump, and a portion located between the first liquid flow channel and the second common flow channel in the cover plate constitutes a beam part which partitions the first common flow channel and the second common flow channel from each other, and which extends in the second direction.

According to the present aspect, it becomes easy to ensure the strength of the cover plate with the beam parts. Therefore, when bonding the actuator plate and the cover plate to each other, the bonding load can effectively be applied between the actuator plate and the cover plate. As a result, it is possible to surely bond the actuator plate and the cover plate to each other to prevent the leakage of the ink through an area between the actuator plate and the cover plate.

(6) In the head chip according to (5) described above, it is preferable that the communication groove is provided to the beam part, and a width in the first direction of the communication groove is narrower than a width of the beam part in the first direction.

According to the present aspect, by providing the beam part with the communication groove, it becomes easy to ensure the depth of the communication groove. Therefore, it is possible to efficiently introduce the raw material gas of the protective film into the non-jet channels through the open apertures.

Moreover, since the width in the first direction of the communication groove is narrower than the width in the first direction of the beam part, a portion located at the outer side of the communication groove out of the beam part forms a pressure receiving area. The pressure receiving area functions as a pressure receiving surface for receiving the load which acts between the actuator plate and the cover plate when bonding the actuator plate and the cover plate to each other. Thus, it is possible to effectively apply the bonding load between the actuator plate and the cover plate. As a result, it is possible to prevent the leakage of the ink or the like through the area between the actuator plate and the cover plate.

(7) In the head chip according to (6) described above, it is preferable that the communication groove overlaps the first common flow channel and the second common flow channel in a stacking direction in which the actuator plate and the cover plate are stacked on one another.

According to the present aspect, it becomes easy to ensure the depth of the communication groove, and therefore, it is possible to efficiently introduce the raw material gas of the protective film into the non-jet channels through the open apertures.

(8) In the head chip according to any of (2) to (7) described above, it is preferable that the first non-jet channel includes a first extension part extending in the first direction, and a first uprise part having a groove depth gradually decreasing in a direction from the first extension part toward the second channel area in the first direction, the second non-jet channel includes a second extension part extending in the first direction, and a second uprise part having a groove depth gradually decreasing in a direction from the second extension part toward the first channel area in the first direction, the first uprise part traverses the common groove in the first direction, and has a communication portion with the common groove constituting the first inside open aperture, and the second uprise part traverses the common groove in the first direction, and has a communication portion with the common groove constituting the second inside open aperture.

According to the present aspect, it is easy to ensure the aperture area of the inside open aperture compared to when the common groove is communicated in an end portion of the uprise part. Thus, it is possible to efficiently introduce the formation material of the protective film into the non-jet channels through the inside open apertures.

(9) The liquid jet head according to the present aspect includes the head chip according to any of the aspects (1) to (8) described above.

According to the present aspect, since the head chip according to any of the aspects described above is provided, it is possible to prevent the short circuit or the like of the electrodes caused by the liquid, and thus, it is possible to maintain the excellent jet performance over a long period of time.

(10) The liquid jet recording device according to the present aspect includes the liquid jet head according to the aspect (9) described above.

According to the present aspect, since the liquid jet head according to the aspect described above is provided, it is possible to prevent the short circuit or the like of the electrodes caused by the liquid, and thus, it is possible to maintain the excellent jet performance over a long period of time.

(11) The method of manufacturing a head chip according to an aspect of the present disclosure is a method of manufacturing the head chip of introducing the formation material of the protective film into the non-jet channels through the open apertures, the head chip including an actuator plate in which a jet channel extending in a first direction and a non-jet channel extending in the first direction are arranged in a second direction crossing the first direction, a cover plate which includes a liquid flow channel communicated with the jet channel, and which is stacked on the actuator plate, and a communication plate which has a communication hole communicated with the jet channel in a central portion in the first direction, and which is stacked on the actuator plate at an opposite side to the cover plate, in the actuator plate, open apertures which communicate an inside and an outside of the non-jet channel with each other being formed in both end portions of the non-jet channel in the first direction, and the method including a protective film formation step of forming protective films on an inner surface of the jet channel and an inner surface of the non-jet channel, wherein in the protective film formation step, a formation material of the protective films is introduced into the jet channel through the liquid flow channel and the communication hole, and the formation material of the protective films is introduced into the non-jet channel through the open apertures.

According to the present aspect, by introducing the formation material of the protective film into the jet channel through the liquid flow channel and the communication hole, and introducing the formation material of the protective film into the non-jet channel through the open apertures, it is possible to effectively form the protective film on the inner surface of the jet channel and the inner surface of the non-jet channel.

As a result, it is possible to prevent the short circuit or the like of the electrodes formed on the inner surfaces of the jet channels and the non-jet channels caused by, for example, the liquid having entered the jet channels and the non-jet channels.

According to an aspect of the present disclosure, it is possible to prevent the short circuit of the electrodes caused by the liquid, and thus, it is possible to maintain the excellent jet performance over a long period of time.

DETAILED DESCRIPTION OF THE PREFERRED EMBODIMENTS

Figure 1:
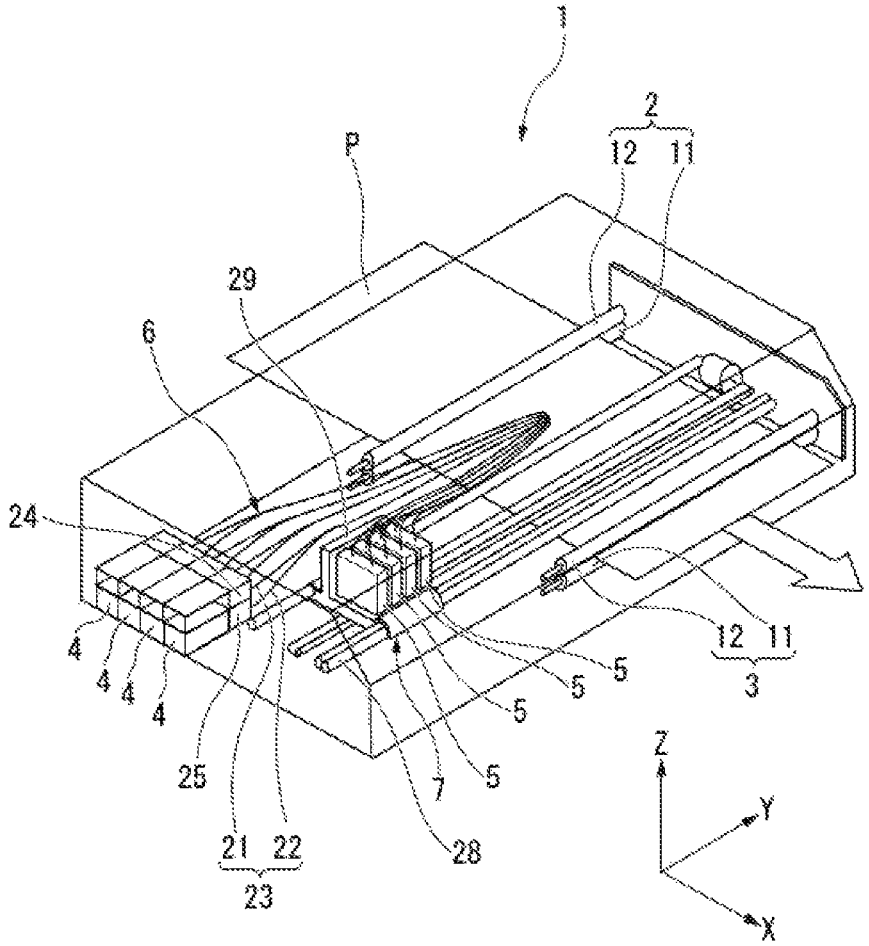
FIG. 1 is a schematic configuration diagram of an inkjet printer according to a first embodiment.

Some embodiments according to the present disclosure will hereinafter be described with reference to the drawings. In the embodiments and a modified example described hereinafter, corresponding configurations are denoted by the same reference symbols and the description thereof will be omitted in some cases. It should be noted that in the following description, expressions representing relative or absolute arrangement such as "parallel," "perpendicular," "center," and "coaxial" not only represent strictly such an arrangement, but also represent the state of being relatively displaced with a tolerance, or an angle or a distance to the extent that the same function can be obtained. In the following embodiments, the description will be presented citing an inkjet printer (hereinafter simply referred to as a printer) for performing recording on a recording target medium using ink (liquid) as an example. It should be noted that the scale size of each member is arbitrarily modified so as to provide a recognizable size to the member in the drawings used in the following description.

First Embodiment

[Printer 1]

FIG. 1 is a schematic configuration diagram of the printer 1.

As shown in FIG. 1, the printer (a liquid jet recording device) 1 according to the present embodiment is provided with a pair of conveying mechanisms 2, 3, ink tanks 4, inkjet heads (liquid jet heads) 5, an ink circulation mechanism 6, and a scanning mechanism 7.

In the following explanation, the description is presented using an orthogonal coordinate system of X, Y, and Z as needed. In this case, the X direction (a second direction) coincides with a conveying direction (a sub-scanning direction) of a recording target medium P (e.g., paper). The Y direction (a first direction) coincides with a scanning direction (a main scanning direction) of the scanning mechanism 7. The Z direction is a height direction (a gravitational direction) perpendicular to the X direction and the Y direction. In the following explanation, the description will be presented defining an arrow side as a positive (+) side, and an opposite side to the arrow as a negative (−) side in the drawings in each of the X direction, the Y direction, and the Z direction. In the present embodiment, the +Z side corresponds to an upward direction in the gravitational direction, and the −Z side corresponds to a downward direction in the gravitational direction.

The conveying mechanisms 2, 3 convey the recording target medium P toward the +X side. The conveying mechanisms 2, 3 each include a pair of rollers 11, 12 extending in, for example, the Y direction.

The ink tanks 4 respectively house ink of four colors such as yellow, magenta, cyan, and black. The inkjet heads 5 are configured so as to be able to respectively eject the ink of four colors, namely yellow, magenta, cyan, and black in accordance with the ink tank 4 coupled thereto. It should be noted that the ink to be housed in the ink tanks 4 can be conductive ink, or can also be nonconductive ink.

Figure 2:
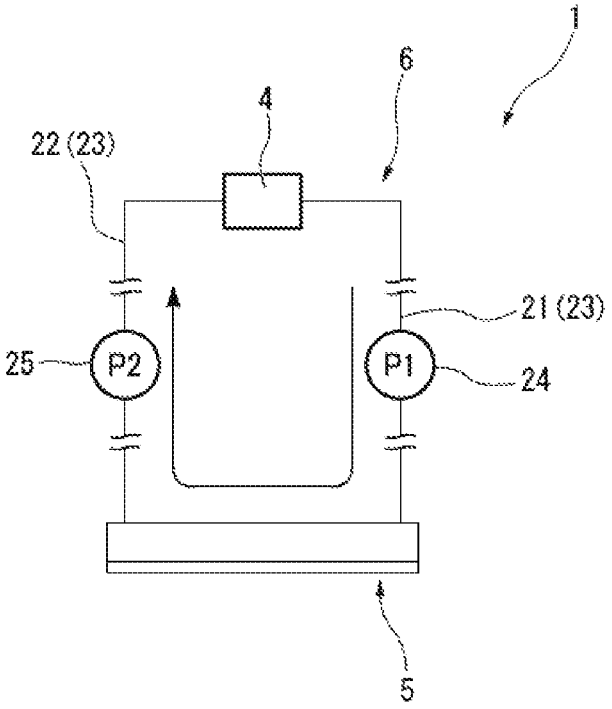
FIG. 2 is a schematic configuration diagram of an inkjet head and an ink circulation mechanism according to the first embodiment.

FIG. 2 is a schematic configuration diagram of the inkjet head 5 and the ink circulation mechanism 6.

As shown in FIG. 1 and FIG. 2, the ink circulation mechanism 6 circulates the ink between the ink tank 4 and the inkjet head 5. Specifically, the ink circulation mechanism 6 is provided with a circulation flow channel 23 having an ink supply tube 21 and an ink discharge tube 22, a pressure pump 24 coupled to the ink supply tube 21, and a suction pump 25 coupled to the ink discharge tube 22.

The pressure pump 24 pressurizes the inside of the ink supply tube 21 to deliver the ink to the inkjet head 5 through the ink supply tube 21. Thus, the ink supply tube 21 is provided with positive pressure with respect to the ink jet head 5.

The suction pump 25 is depressurizes the inside of the ink discharge tube 22 to suction the ink from the inkjet head 5 through the ink discharge tube 22. Thus, the ink discharge tube 22 is provided with negative pressure with respect to the ink jet head 5. It is arranged that the ink can circulate between the inkjet head 5 and the ink tank 4 through the circulation flow channel 23 by driving the pressure pump 24 and the suction pump 25.

The scanning mechanism 7 reciprocates the inkjet heads 5 in the Y direction. The scanning mechanism 7 is provided with a guide rail 28 extending in the Y direction, and a carriage 29 movably supported by the guide rail 28.

<Inkjet Head 5>

As shown in FIG. 1, the inkjet head 5 is mounted on the carriage 29. In the illustrated example, the plurality of inkjet heads 5 is mounted on the single carriage 29 so as to be arranged side by side in the Y direction. The inkjet heads 5 are each provided with a head chip 50 (see FIG. 3), an ink supply section (not shown) for coupling the ink circulation mechanism 6 and the head chip 50, and a control section (not shown) for applying a drive voltage to the head chip 50.

<Head Chip 50>

Figure 3:
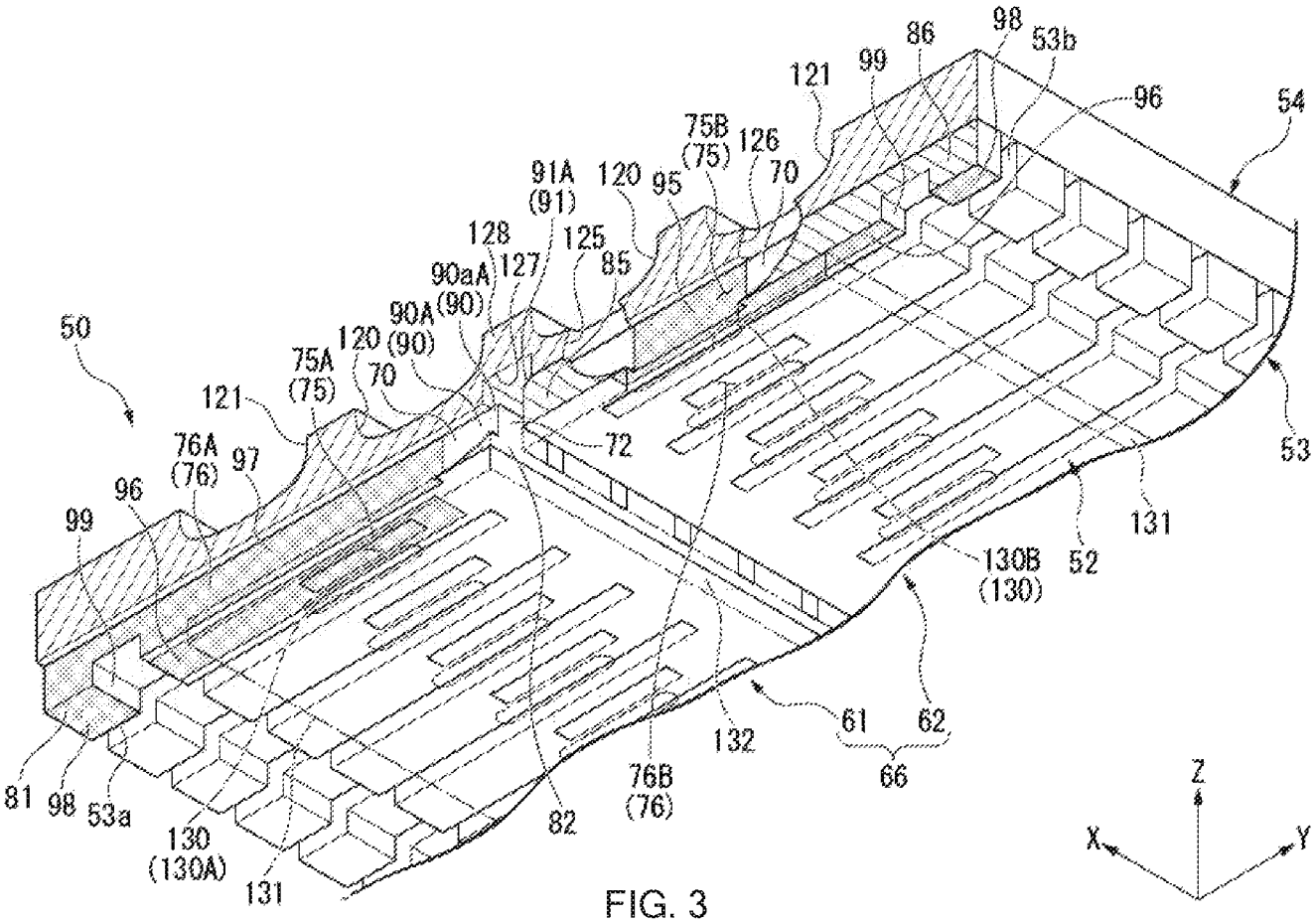
FIG. 3 is a perspective view of a head chip according to the first embodiment in a state in which a nozzle plate is detached viewed from a −Z side.
Figure 4:
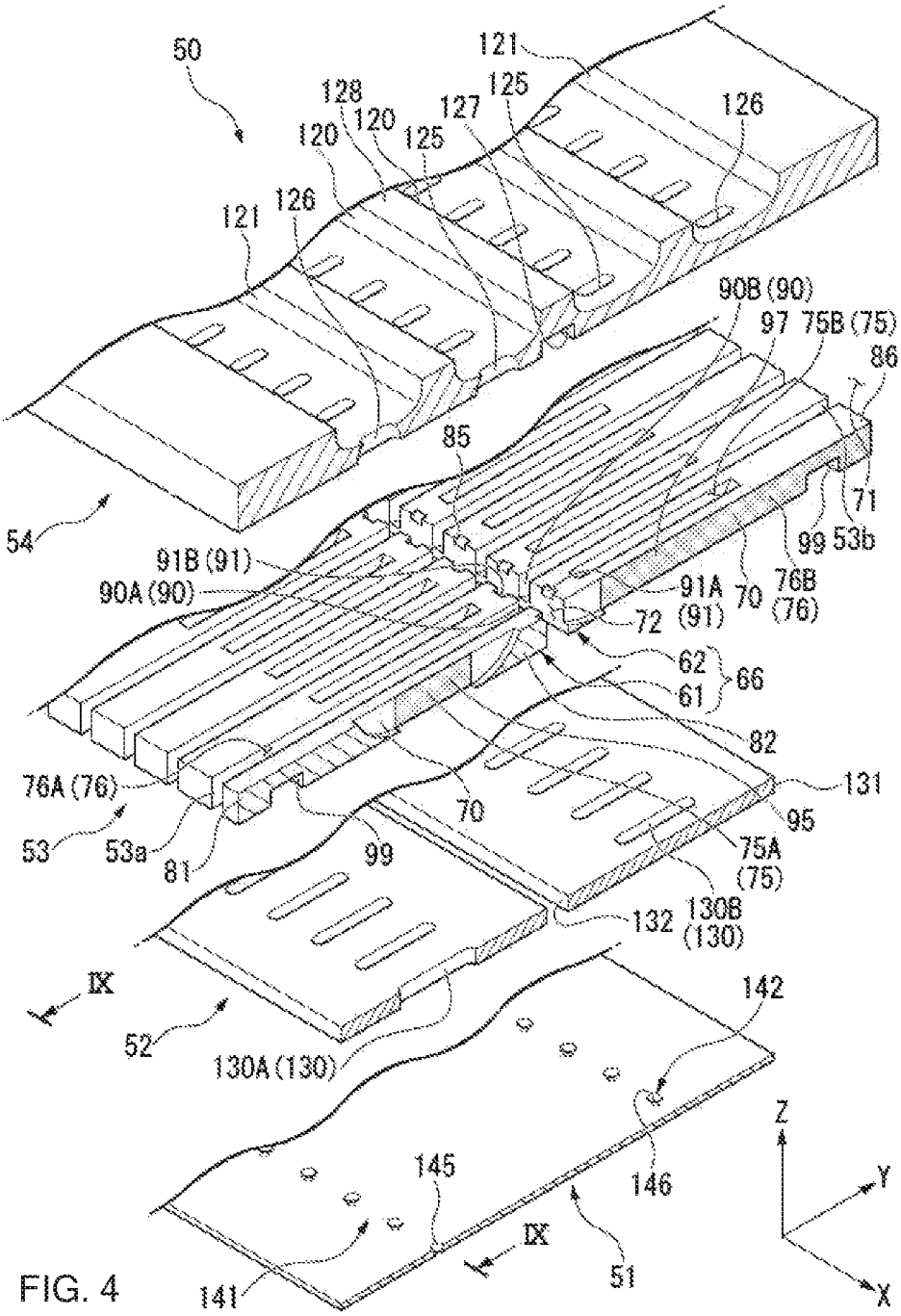
FIG. 4 is an exploded perspective view of the head chip according to the first embodiment.

FIG. 3 is a perspective view of the head chip 50 in the state in which a nozzle plate 51 is detached viewed from a −Z side. FIG. 4 is an exploded perspective view of the head chip 50.

The head chip 50 shown in FIG. 3 and FIG. 4 is a so-called circulating side-shooting type head chip which circulates the ink with the ink tank 4, and at the same time, ejects the ink from a central portion in an extending direction (the Y direction) in an ejection channel 75 described later. The head chip 50 is provided with the nozzle plate 51 (see FIG. 4), an intermediate plate (a communication plate) 52, an actuator plate 53, and a cover plate 54. The head chip 50 is provided with a configuration in which the nozzle plate 51, the intermediate plate 53, the actuator plate 53, and the cover plate 54 are stacked on one another in this order in the Z direction. In the following description, the description is presented in some cases defining a direction (+Z side) from the nozzle plate 51 toward the cover plate 54 as a reverse side, and a direction (−Z side) from the cover plate 54 toward the nozzle plate 51 along the Z direction as an obverse side.

The actuator plate 53 is formed of a piezoelectric material such as PZT (lead zirconate titanate). The actuator plate 53 is a so-called chevron substrate formed by, for example, stacking two piezoelectric plates different in polarization direction in the Z direction on one another. It should be noted that the actuator plate 53 can be a so-called monopole substrate in which the polarization direction is unidirectional throughout the entire area in the Z direction.

Figure 5:
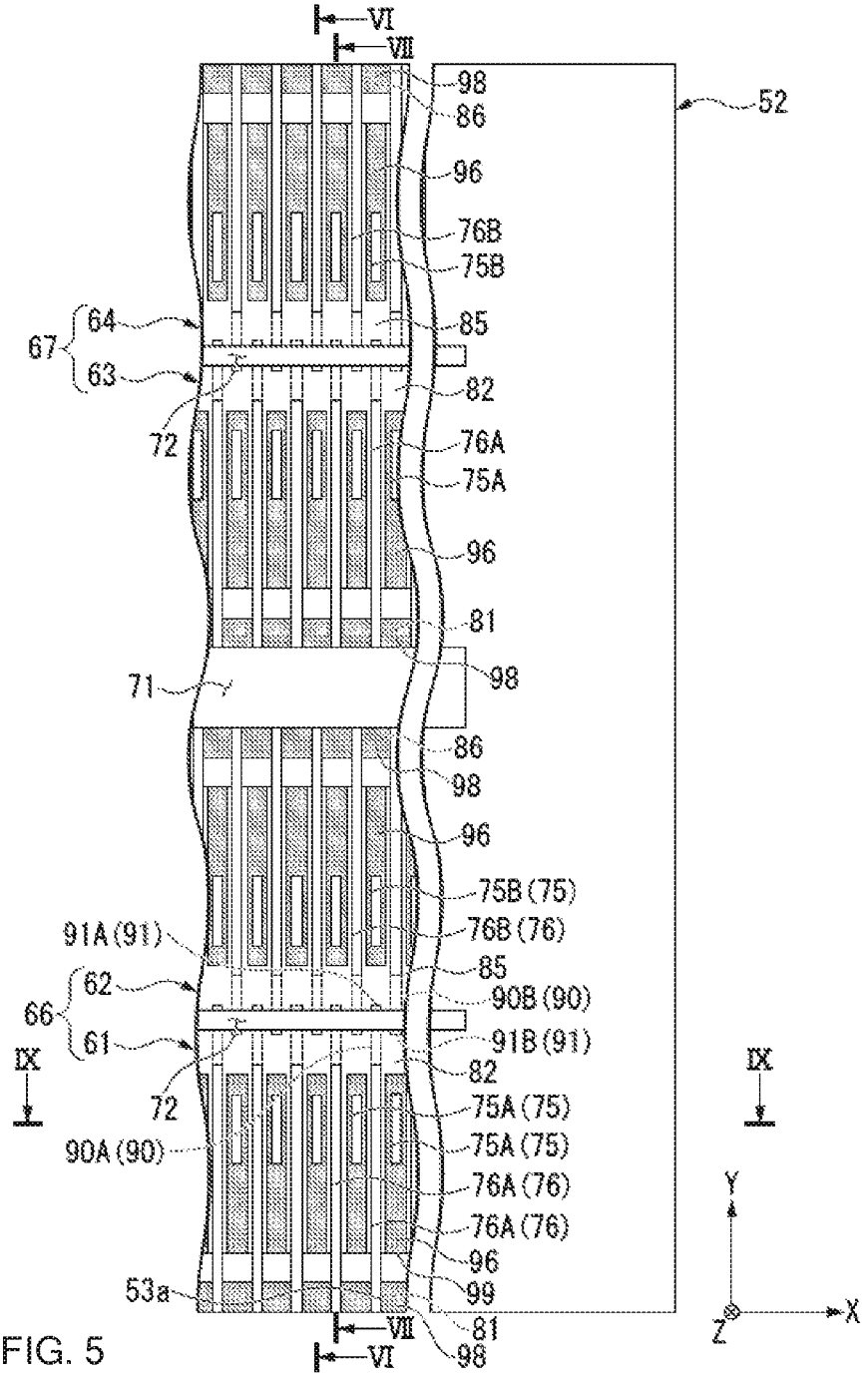
FIG. 5 is a bottom view of an actuator plate according to the first embodiment.

FIG. 5 is a bottom view of the actuator plate 53.

As shown in FIG. 4 and FIG. 5, the actuator plate 53 is provided with a plurality of (e.g., 4 columns of) channel columns 61 through 64. The channel columns 61 through 64 extend in the X direction, and at the same time, are arranged at intervals in the Y direction. In the present embodiment, the channel columns 61 through 64 consist of a first channel A column (a first channel area) 61, a first channel B column (a second channel area) 62, a second channel A column (the first channel area) 63, and a second channel B column (the second channel area) 64. The first channel A column 61 and the first channel B column 62 constitute a first channel group 66. The second channel A column 63 and the second channel B column 64 constitute a second channel group 67.

As shown in FIG. 5, in the actuator plate 53, a portion located between the channel groups 66, 67 is provided with a group separation groove 71. The group separation groove 71 penetrates the actuator plate 53 in the Z direction, and at the same time, extends in the X direction. The group separation groove 71 separates the channel groups 66, 67 from each other. It should be noted that the head chip 50 forms substantially the same configurations at both sides in the Y direction with respect to the group separation groove 71. Therefore, in the following description, the configuration at the −Y side with respect to the group separation groove 71 will mainly be described, and the description of the configuration at the +Y side will arbitrarily be omitted.

In the actuator plate 53, a portion located between the first channel A column 61 and the first channel B column 62, and a portion located between the second channel A column 63 and the second channel B column 64 are each provided with a column separation groove 72. The column separation groove 72 penetrates the actuator plate 53 in the Z direction, and at the same time, extends in the X direction. The column separation groove 72 is made narrower in width in the Y direction than the group separation groove 71. It should be noted that the separation grooves 71, 72 do not penetrate the actuator plate 53 in the X direction.

The configuration of the channel columns 61 through 64 will be hereinafter described citing the first channel A column 61 as an example. In the following description, constituents related to the column A in each of the channel columns 61 through 64 are denoted by reference symbols suffixed with A, constituents related to the column B are denoted by reference symbols suffixed with B, and the description of the configurations which are the same or corresponding between the column A and the column B will be omitted in some cases. Further, in each of the channel columns 61 through 64, when there is no need to distinguish the column A and the column B from each other, the suffix A or B will be omitted.

The first channel A column 61 is formed at an opposite side (the −Y side) to the group separation groove 71 with respect to the column separation groove 72 in the actuator plate 53. The first channel A column 61 has ejection channels (first jet channels) 75A filled with the ink, and non-ejection channels (first non-jet channels) 76A not filled with the ink. The channels 75A, 76A each extend linearly in the Y direction, and at the same time, are arranged side by side at intervals in the X direction in the plan view viewed from the Z direction. In the actuator plate 53, a portion located between the ejection channel 75A and the non-ejection channel 76A constitutes a drive wall 70 (see FIG. 4) which partitions the ejection channel 75A and the non-ejection channel 76A from each other in the X direction. It should be noted that the configuration in which the channel extension direction coincides with the Y direction will be described in the present embodiment, but the channel extension direction can cross the Y direction.

Figure 6:
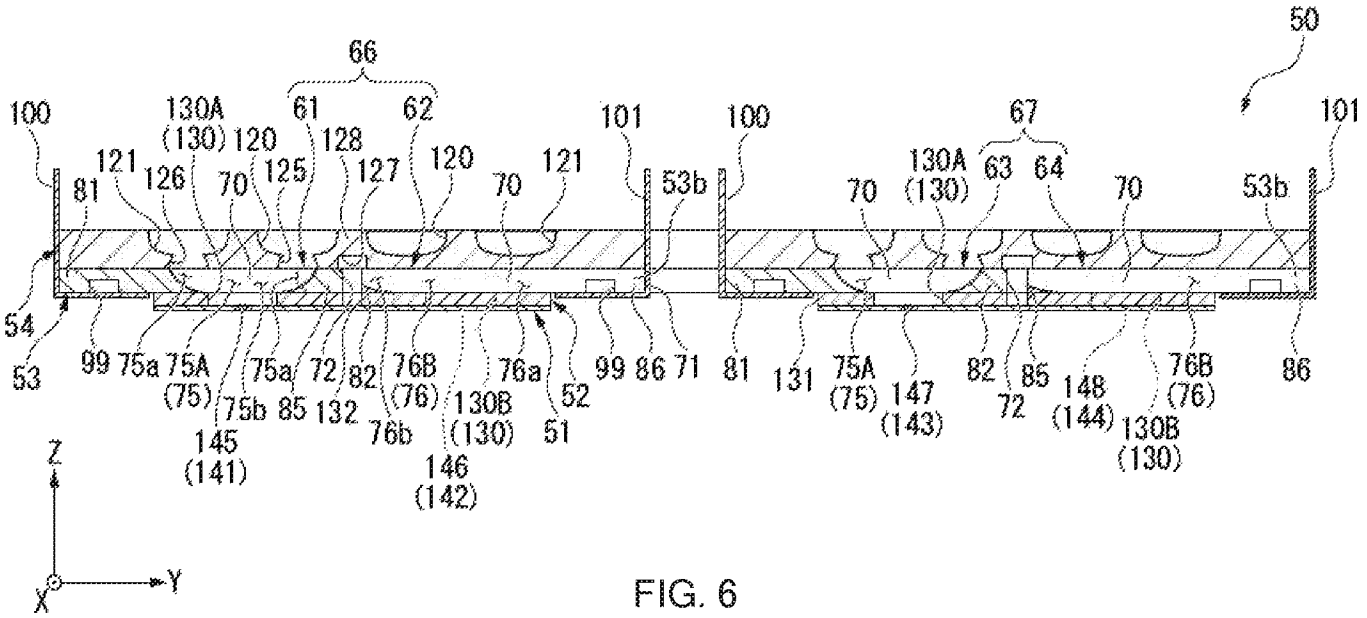
FIG. 6 is a cross-sectional view corresponding to the line VI-VI shown in FIG. 5.

FIG. 6 is a cross-sectional view corresponding to the line VI-VI shown in FIG. 5.

As shown in FIG. 6, the ejection channel 75A is formed to have a curved shape convex toward the obverse surface in a side view viewed from the X direction. The ejection channels 75 are formed by, for example, making a dicer having a disk-like shape enter the actuator plate 53 from the reverse surface (the +Z side) thereof. Specifically, the ejection channel 75A has uprise parts 75*a* located at both end portions in the Y direction, and a penetration part 75*b* located between the uprise parts 75*a*.

The uprise part 75*a* has a circular arc shape which extends along, for example, the curvature radius of the dicer and has a uniform curvature radius when viewed from the X direction. The uprise part 75*a* extends while curving toward the reverse side as getting away from the penetration part 75*b* in the Y direction.

The penetration part 75*b* penetrates the actuator plate 53 in the Z direction.

Figure 7:
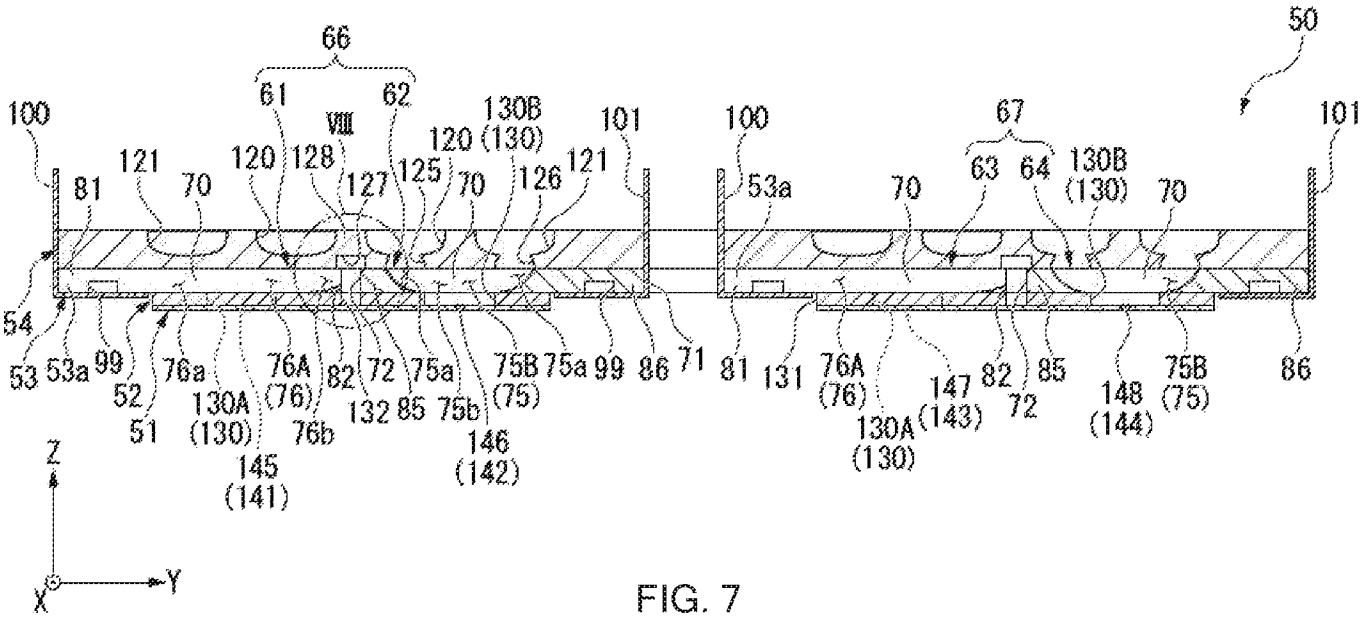
FIG. 7 is a cross-sectional view corresponding to the line VII-VII shown in FIG. 5.

FIG. 7 is a cross-sectional view corresponding to the line VII-VII shown in FIG. 5.

As shown in FIG. 7, the non-ejection channel 76A is adjacent to the ejection channel 75A across the drive wall 70 in the X direction. The non-ejection channel 76A is formed by, for example, making a dicer having a disk-like shape enter the actuator plate 53 from the reverse surface (the +Z side) thereof. The non-ejection channel 76A is provided with a penetration part (a first extension part) 76*a*, and an uprise part (a first uprise part) 76*b*.

The penetration part 76*a* penetrates the actuator plate 53 in the Z direction. In other words, the penetration part 76*a* is formed to have a uniform groove depth in the Z direction. The penetration part 76*a* constitutes a portion other than the +Y side end portion in the non-ejection channel 76.

The uprise part 76*b* constitutes the +Y side end portion in the non-ejection channel 76. The uprise part 76*b* has a circular arc shape which extends along, for example, the curvature radius of the dicer and has a uniform curvature radius when viewed from the X direction. The uprise part 76*b* extends while curving toward the reverse side as getting away from the penetration part 76*a* in the Y direction.

As shown in FIG. 6 and FIG. 7, the dimension in the Y direction of the non-ejection channel 76A is made longer than that of the ejection channel 75A. Specifically, in the non-ejection channel 76A, the −Y side end portion of the penetration part 76*a* is located at the −Y side of the ejection channel 75A, and the +Y side end portion of the uprise part 76*b* is located at the +Y side of the ejection channel 75A.

As shown in FIG. 5, the first channel B column 62 is disposed between the group separation groove 71 and the column separation groove 72 in the actuator plate 53. Similarly to the first channel A column 61 described above, the first channel B column 62 has a configuration in which ejection channels (second ejection channels) 75B and non-ejection channels (second non-ejection channels) 76B are arranged side by side in the X direction. Specifically, the ejection channel 75B and the non-ejection channel 76B are arranged so as to be shifted as much as a half pitch from the arrangement pitch of the ejection channel 75A and the non-ejection channel 76A. Therefore, in the inkjet head 5 according to the present embodiment, the ejection channels 75 of the first channel A column 61 and the first channel B column 62 are arranged in a zigzag manner (a staggered manner), and the non-ejection channels 76 of the first channel A column 61 and the first channel B column 62 are arranged in a zigzag manner (a staggered manner). In other words, the ejection channel 75 and the non-ejection channel 76 are opposed to each other in the Y direction between the channel columns 61, 62 adjacent to each other. It should be noted that the ejection channels 75 can be opposed to each other in the Y direction between the channel columns 61, 62, and the non-ejection channels 76 can be opposed to each other in the Y direction between the channel columns 61, 62. It should be noted that it is possible for the channel columns 61 through 64 to be disposed so as to be shifted by a quarter pitch with respect to the arrangement pitch of the ejection channels 75A and the non-ejection channels 76A in the first channel A column 61.

In the channel columns 61, 62, the ejection channels 75 are formed plane-symmetrically about the X-Z plane passing through the center in the Y direction of the column separation groove 72.

In the channel columns 61, 62, the non-ejection channels 76 are formed plane-symmetrically about the X-Z plane passing through the center in the Y direction of the column separation groove 72.

In the actuator plate 53, a portion located at the −Y side of the ejection channel 75A (the penetration part 75*b*) of the first channel A column 61 constitutes a first outside area 81. In the actuator plate 53, a portion located between a portion located at the +Y side of the ejection channel 75A of the first channel A column 61, and the column separation groove 72 constitutes a first inside area 82.

In the actuator plate 53, a portion located between a portion located at the −Y side of the ejection channel 75B of the first channel B column 62, and the column separation groove 72 constitutes a second inside area 85. In the actuator plate 53, a portion located between a portion located at the +Y side of the ejection channel 75B of the first channel B column 62, and the column separation groove 71 constitutes a second outside area 86.

As shown in FIG. 7, in the first channel A column 61, the penetration part 76*a* of the non-ejection channel 76A penetrates the first outside area 81 in the Y direction and the Z direction. In the penetration part 76*a*, an opening part on an outer surface of the first outside area 81 constitutes an open aperture (a first outside open aperture) 53*a* for communicating the inside and the outside of the non-ejection channel 76A.

Figure 8:
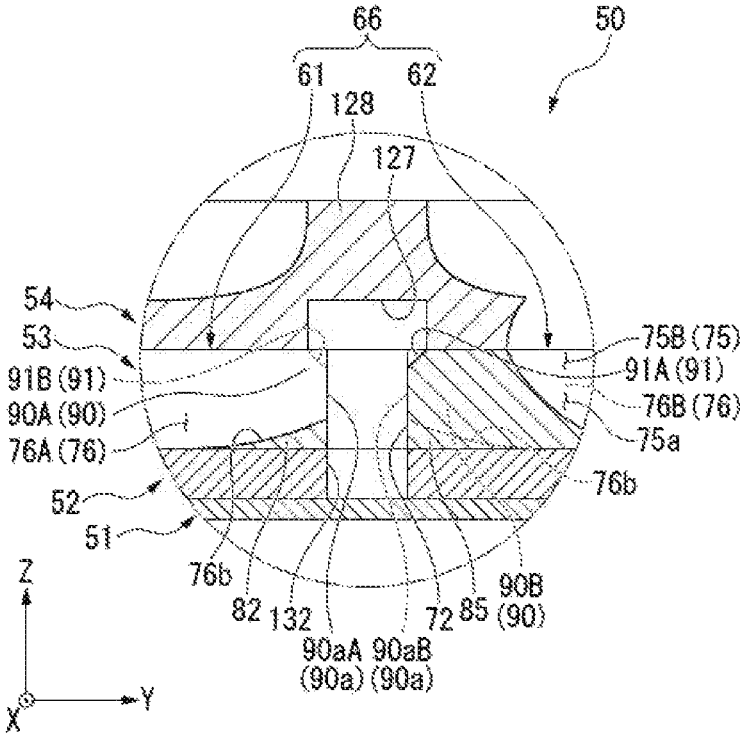
FIG. 8 is an enlarged view of a VIII portion shown in FIG. 7.

FIG. 8 is an enlarged view of a VIII portion shown in FIG. 7.

As shown in FIG. 8, in the first channel A column 61, the uprise part 76*b* of the non-ejection channel 76A traverses the column separation groove 72 in the Y direction. Therefore, a part (the +Y side end portion) of the uprise part 76*b* reaches the second inside area 85 of the first channel B column 62. Specifically, a portion located in the first inside area 82 in the uprise part 76*b* of the non-ejection channel 76A constitutes a communication part 90A for communicating the penetration part 76*a* and the column separation groove 72 with each other. The communication part 90A opens in the column separation groove 72 through an open aperture (a first inside open aperture) 90*a*A. A portion which reaches the second inside area 85 in the uprise part 76*b* of the non-ejection channel 76A constitutes a divided part 91A divided by the column separation groove 72.

As shown in FIG. 6, in the first channel B column 62, the penetration part 76*a* of the non-ejection channel 76B penetrates the second outside area 86 in the Y direction and the Z direction. In the penetration part 76*a*, an opening part on an outer surface of the second outside area 86 constitutes an open aperture (a second outside open aperture) 53*b* for communicating the inside and the outside of the non-ejection channel 76B.

As shown in FIG. 8, in the first channel B column 62, the uprise part (a second uprise part) 76*b* of the non-ejection channel 76B traverses the column separation groove 72 in the Y direction. Therefore, a part (the −Y side end portion) of the uprise part 76*b* reaches the first inside area 82 of the first channel A column 61. Specifically, a portion located in the second inside area 85 in the uprise part 76*b* constituting the first channel B column 62 constitutes a communication part 90B for communicating the penetration part (a second extension part) 76*a* and the column separation groove 72 with each other. The communication part 90B opens in the column separation groove 72 through an open aperture 90*a*B. A portion which reaches the first inside area 82 in the uprise part 76*b* of the non-ejection channel 76B constitutes a divided part 91B divided by the column separation groove 72. It should be noted that the uprise part 76*b* is not required to traverse the column separation groove 72 as long as the uprise part 76*b* is provided with a configuration of being communicated with at least the column separation groove 72. In other words, it is possible for the uprise part 76*b* to have a configuration not provided with the divided parts 91.

Figure 9:
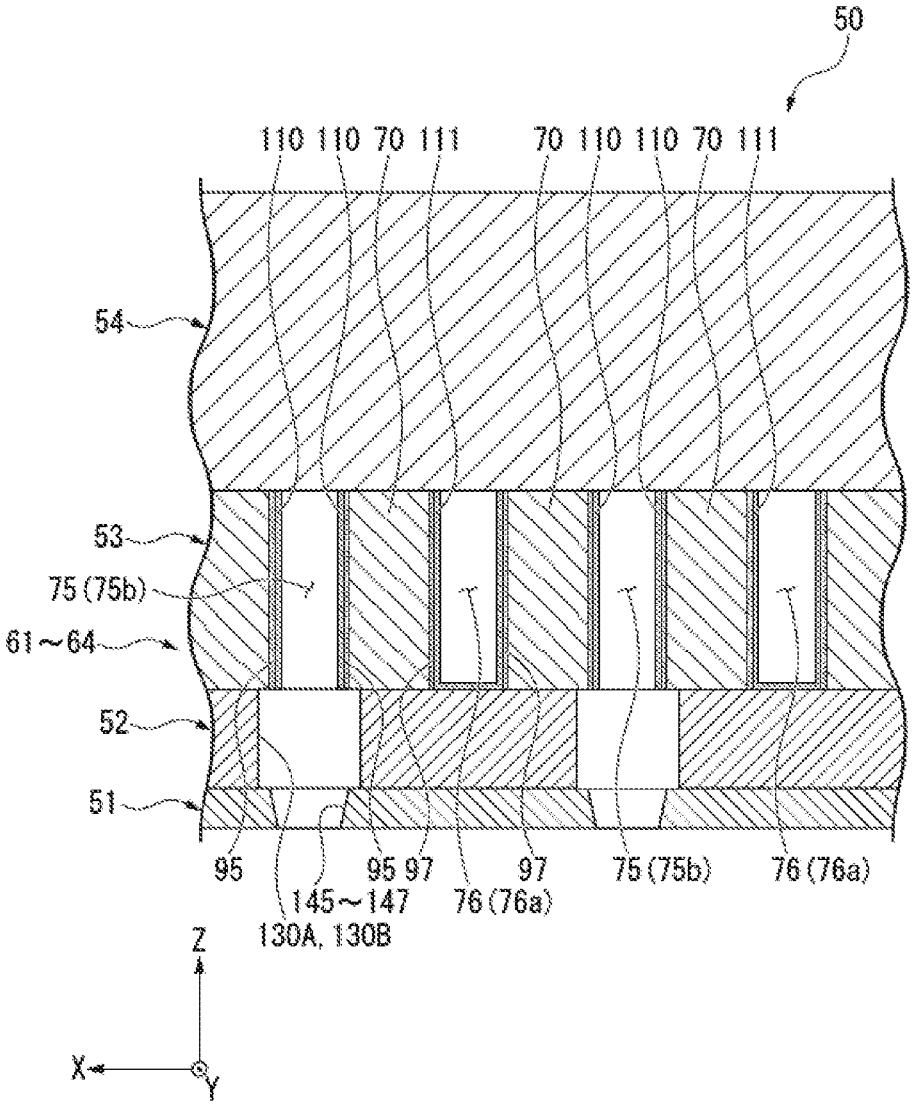
FIG. 9 is a cross-sectional view along the line IX-IX shown in FIG. 4.

FIG. 9 is a cross-sectional view along the line IX-IX shown in FIG. 4.

As shown in FIG. 9, on inside surfaces (surfaces opposed to each other in the X direction in the inner surfaces of the ejection channel 75) of each of the ejection channels 75 in the drive walls 70 of the actuator plate 53, there are respectively formed common electrodes 95. The common electrodes 95 are each formed throughout the entire area in the Z direction on the inside surface of the ejection channel 75. The common electrodes 95 are made equivalent in length in the Y direction to the penetration part 75*b* of the ejection channel 75 (the length in the Y direction of the common electrodes 95 is made equivalent to an opening length of the ejection channel 75 on the obverse surface of the actuator plate 53).

As shown in FIG. 5, on the obverse surface of the actuator plate 53, there is formed a plurality common terminals 96. The common terminals 96 are made to have strip-like shapes extending in the Y direction in parallel to each other. The common terminals 96 are each coupled to a pair of the common electrodes 95 at an opening edge of the ejection channel 75 corresponding to the common terminal 96. The common terminals 96 are each terminated in corresponding one of the outside areas 81, 86.

As shown in FIG. 9, on inside surfaces (surfaces opposed to each other in the X direction in the non-ejection channel 76) of each of the non-ejection channels 76 in the drive walls 70 of the actuator plate 53, there are respectively formed individual electrodes 97. The individual electrodes 97 are each formed throughout the entire area in the Z direction on the inside surface of the non-ejection channel 76.

As shown in FIG. 5, in a portion located at an outer side in the Y direction of the common terminal 96 on the obverse surface of each of the outside areas 81, 86, there is formed an individual terminal 98. The individual terminal 98 is made shaped like a strip extending in the X direction. The individual terminal 98 couples the individual electrodes 97 opposed to each other in the X direction across the ejection channel 75 at the opening edges of the non-ejection channels 76 opposed to each other in the X direction across the ejection channel 75. It should be noted that in a portion located between the common terminal 96 and the individual terminal 98 in each of the outside areas 81, 86, there is formed a compartment groove 99. The compartment groove 99 extends in the X direction in each of the outside areas 81, 86. The compartment groove 99 separates the common terminal 96 and the individual terminal 98 from each other. It should be noted that in FIG. 3, FIG. 4, and so on, the electrodes 95, 97 and the terminals 96, 98 are only partially shown.

As shown in FIG. 6, to the obverse surface of the first outside area 81, there is pressure-bonded a first flexible printed board 100. The first flexible printed board 100 is coupled to the common terminals 96 and the individual terminals 98 corresponding to the first channel A column 61 on the obverse surface of the first outside area 81. The first flexible printed board 100 is extracted toward the +Z side through the outside of the actuator plate 53.

To the obverse surface of the second outside area 86, there is pressure-bonded a second flexible printed board 101. The second flexible printed board 101 is coupled to the common terminals 96 and the individual terminals 98 corresponding to the first channel B column 62 on the obverse surface of the second outside area 86. The second flexible printed board 101 is extracted toward the +Z side through the inside of the group separation groove 71.

As shown in FIG. 9, on the inner surface of the ejection channel 75, there is formed a first protective film 110. The first protective film 110 is formed throughout the entire inner surface of the ejection channel 75. The first protective film 110 covers the common electrode 95. The first protective film 110 prevents, for example, the common electrode 95 and the ink from making contact with each other. It should be noted that it is sufficient for the first protective film 110 to cover at least the common electrode 95 on the inside surface of the ejection channel 75.

On an inner surface of the non-ejection channel 76, there is formed a second protective film 111. The second protective film 111 is formed throughout the entire inner surface of the non-ejection channel 76. The second protective film 111 covers the individual electrode 97. The second protective film 111 prevents, for example, the individual electrode 97 and the ink from making contact with each other. It should be noted that it is sufficient for the second protective film 111 to cover at least the individual electrode 97 on the inside surface of the non-ejection channel 76.

The protective films 110, 111 each include an organic insulating material such as a para-xylylene resin material (e.g., parylene (a registered trademark)). The protective films 110, 111 can be formed of tantalum oxide (Ta2O5), silicon nitride (SiN), silicon carbide (SiC), silicon oxide (SiO2), diamond-like carbon, or the like, or can include at least any one of these materials.

<Cover Plate 54>

As shown in FIG. 3 and FIG. 4, the cover plate 54 is bonded to the reverse surface of the actuator plate 53 so as to close the channel groups 66, 67. In the cover plate 54, at positions corresponding to the channel columns 61 through 64, there are formed entrance common ink chambers 120 and exit common ink chambers 121.

The entrance common ink chamber 120 is formed at a position overlapping the +Y side end portion of the ejection channel 75A in the plan view in, for example, the first channel A column 61. The entrance common ink chamber 120 extends in the X direction with a length sufficient for straddling, for example, the first channel A column 61, and at the same time, opens on the reverse surface of the cover plate 54.

The exit common ink chamber 121 is formed at a position overlapping the −Y side end portion of the ejection channel 75A in the plan view in, for example, the first channel A column 61. The exit common ink chamber 121 extends in the X direction with a length sufficient for straddling the first channel A column 61, and at the same time, opens on the reverse surface of the cover plate 54.

In the entrance common ink chamber 120, at the position corresponding to the ejection channels 75A in the first channel A column 61, there is formed an entrance slit (a first liquid flow channel, a second liquid flow channel) 125. The entrance slit 125 communicates the +Y side end portion of each of the ejection channels 75A and the entrance common ink chamber 120 with each other.

In the exit common ink chamber 121, at the position corresponding to the ejection channels 75A in the first channel A column 61, there is formed an exit slit (the first liquid flow channel, the second liquid flow channel) 126. The exit slit 126 communicates the −Y side end portion of each of the ejection channels 75A and the exit common ink chamber 121 with each other. Therefore, the entrance slit 125 and the exit slit 126 are communicated with the ejection channels 75A on the one hand, but are not communicated with the non-ejection channel 76A on the other hand.

In the cover plate 54, an area between the entrance common ink chambers (a first common flow channel, a second common flow channel) 120 adjacent to each other forms a beam part 128. The beam part 128 extends linearly along the X direction. The beam part 128 partitions the entrance common ink chambers 120 adjacent to each other.

As shown in FIG. 8, on the obverse surface of the cover plate 54 (the beam part 128), at a position overlapping the column separation groove 72 in the plan view, there is formed a communication groove 127. The communication groove 127 opens on the obverse surface of the cover plate 54, and is communicated with the column separation groove 72. The communication groove 127 extends in the X direction with the length sufficient for traversing the channel columns 61 through 64. The dimension in the Y direction of the communication groove 127 is made longer than the column separation groove 72. Therefore, the communication groove 127 is communicated with the communication part 90 of the non-ejection channel 76 on the reverse surface of the actuator plate 53.

<Intermediate Plate 52>

The intermediate plate 52 is bonded to the obverse surface of the actuator plate 53 so as to close the channel groups 66, 67. The intermediate plate 52 is formed of a piezoelectric material such as PZT similarly to the actuator plate 53. The intermediate plate 52 is thinner in thickness in the Z direction than the actuator plate 53. The intermediate plate 52 becomes shorter in dimension in the Y direction than the actuator plate 53. Therefore, at the both sides in the Y direction of the intermediate plate 52, there are exposed the both end portions (e.g., the first outside area 81) in the Y direction in the actuator plate 53. In the both end portions in the Y direction in the actuator plate 53, the portion exposed from the intermediate plate 52 functions as a pressure-bonding area of each of the flexible printed boards 100, 101.

In the intermediate plate 52, a portion which overlaps the penetration part 75*b* of each of the ejection channels 75 in the plan view is provided with a communication hole 130. The communication hole 130 includes an A column communication hole 130A communicated with the ejection channel 75A, and a B column communication hole 130B communicated with the ejection channel 75B. The communication hole 130 is communicated with the penetration part 75*b* of corresponding one of the ejection channels 75 at the obverse surface side of the actuator plate 53. The communication hole 130 is formed to have an oval shape having a longitudinal direction set to the Y direction. The communication hole 130 is shorter in dimension in the Y direction than the penetration part 75*b*. In contrast, the communication hole 130 is wider in dimension in the X direction than the penetration part 75*b*. It should be noted that the communication hole 130 can be shorter in dimension in the X direction than the penetration part 75*b*.

At a position overlapping the group separation groove 71 in the plan view in the intermediate plate 52, there is formed a first open groove 131. The first open groove 131 opens the group separation groove 71, and at the same time, exposes the second outside area 86 of the first channel B column 62 and the first outside area 81 of the second channel A column 63. The first open groove 131 is formed to have a shape like a strip extending in the X direction having an equivalent length to that of the group separation groove 71.

At a position overlapping the column separation groove 72 in the plan view in the intermediate plate 52, there is formed a second open groove 132. The second open groove 132 opens at least the column separation groove 72. The second open groove 132 is formed to have a shape like a strip extending in the X direction having an equivalent length to that of the column separation groove 72. It should be noted that the length in the Y direction of the second open groove 132 can be narrower or wider than that of the column separation groove 72 as long as there is formed a configuration in which at least a part of the column separation groove 72 is opened through the second open groove 132. In the present embodiment, the second open groove 132 and the column separation groove 72 are made equivalent in length in the Y direction to each other.

As shown in FIG. 4, the nozzle plate 51 is fixed to a surface of the intermediate plate 52 with an adhesive or the like. The nozzle plate 51 is made equivalent in width in the Y direction to the intermediate plate 52. In the present embodiment, the nozzle plate 51 is formed of a resin material such as polyimide so as to have a thickness of about 50 μm. It should be noted that it is possible for the nozzle plate 51 to have a single layer structure or a laminate structure with a metal material (SUS, Ni—Pd, or the like), glass, silicone, or the like besides the resin material.

The nozzle plate 51 is provided with four nozzle columns (a first nozzle A column 141, a first nozzle B column 142, a second nozzle A column 143, and a second nozzle B column 144) which extend in the X direction and are arranged at intervals in the Y direction.

The nozzle columns 141 through 144 each have a plurality of nozzle holes (first nozzle A holes 145, first nozzle B holes 146, second nozzle A holes 147, and second nozzle B holes 148) penetrating the nozzle plate 51 in the Z direction. The nozzle holes 145 through 148 are each arranged at intervals in the X direction. Each of the nozzle holes 145 through 148 is formed to have, for example, a taper shape having the inner diameter gradually decreasing in a direction from the reverse side toward the obverse side. The maximum inner diameter of each of the nozzle holes 145 through 148 becomes equivalent to the width in the Y direction of the ejection channel 75.

As shown in FIG. 6 and FIG. 9, the first nozzle A holes 145 are each communicated with a central portion in the Y direction of the ejection channel 75A in the first channel A column 61 through the A column communication hole (the first communication hole) 130A. The first nozzle B holes 146 are each communicated with a central portion in the Y direction of the ejection channel 75B in the first channel B column 62 through the B column communication hole (the second communication hole) 130B. The second nozzle A holes 147 are each communicated with a central portion in the Y direction of the ejection channel 75A in the second channel A column 63 through the A column communication hole 130A. The second nozzle B holes 148 are each communicated with a central portion in the Y direction of the ejection channel 75B in the second channel B column 64 through the B column communication hole 130B. Therefore, the non-ejection channels 76 are not communicated with the nozzle holes 145 through 148, but are covered with the nozzle plate 51 from the obverse surface side.

[Operation Method of Printer 1]

Then, when recording a character, a figure, or the like on the recording target medium P using the printer 1 configured as described above will hereinafter be described.

It should be noted that it is assumed that as an initial state, the sufficient ink having colors different from each other is respectively encapsulated in the four ink tanks 4 shown in FIG. 1. Further, there is provided the state in which the inkjet heads 5 are filled with the ink in the ink tanks 4 via the ink circulation mechanisms 6, respectively.

In such an initial state, when making the printer 1 operate, the recording target medium P is conveyed toward the +X side while being pinched by the rollers 11, 12 of the conveying mechanisms 2, 3. Further, by the carriage 29 moving in the Y direction at the same time, the inkjet heads 5 mounted on the carriage 29 reciprocate in the Y direction.

During the reciprocation of the inkjet heads 5, the ink is arbitrarily ejected toward the recording target medium P from each of the inkjet heads 5. Thus, it is possible to perform recording of the character, the image, and the like on the recording target medium P.

Here, the motion of each of the inkjet heads 5 will hereinafter be described in detail.

In such circulating side-shooting type inkjet head 5 as in the present embodiment, first, by making the pressure pump 24 and the suction pump 25 shown in FIG. 2 operate, the ink is circulated in the circulation flow channel 23. In this case, the ink circulating through the ink supply tube 21 is supplied into each of the ejection channels 75 through the entrance common ink chambers 120 and the entrance slits 125. The ink supplied into each of the ejection channels 75 circulates each of the ejection channels 75 in the Y direction. Then, the ink is discharged to the exit common ink chambers 121 through the exit slits 126, and is then returned to the ink tank 4 through the ink discharge tube 22. Thus, it is possible to circulate the ink between the inkjet head 5 and the ink tank 4.

Then, when the reciprocation of the inkjet head 5 is started due to the translation of the carriage 29 (see FIG. 1), the drive voltages are applied to the electrodes 95, 97 via the flexible printed boards 100, 101. On this occasion, the individual electrode 97 is set at a drive potential Vdd, and the common electrode 95 is set at a reference potential GND to apply the drive voltage between the electrodes 95, 97. Then, a thickness shear deformation occurs in two drive walls 70 partitioning the ejection channel 75, and the two drive walls 70 each deform so as to protrude toward the non-ejection channel 76. Specifically, by applying the voltage between the electrodes 95, 97, the drive walls 70 each make a flexural deformation to form a V-shape centering on an intermediate portion in the Z direction. Thus, the volume of the ejection channel 75 increases. Further, since the volume of the ejection channel 75 has increased, the ink retained in the entrance common ink chamber 120 is induced into the ejection channel 75 through the entrance slit 125. The ink having been induced into the ejection channel 75 propagates inside the ejection channel 75 as a pressure wave. The voltage applied between the electrodes 95, 97 is set to zero at the timing when the pressure wave reaches corresponding one of the nozzle holes 145 through 148. Thus, the drive walls 70 are restored, and the volume of the ejection channel 75 having once increased is restored to the original volume. Due to this operation, the internal pressure of the ejection channel 75 increases to pressurize the ink. As a result, it is possible to record the character, the figure, and the like on the recording target medium P as described above by the ink shaped like a droplet being ejected outside through the communication hole 130 and corresponding one of the nozzle holes 145 through 148.

<Method of Manufacturing Head Chip 50>

Figure 10:
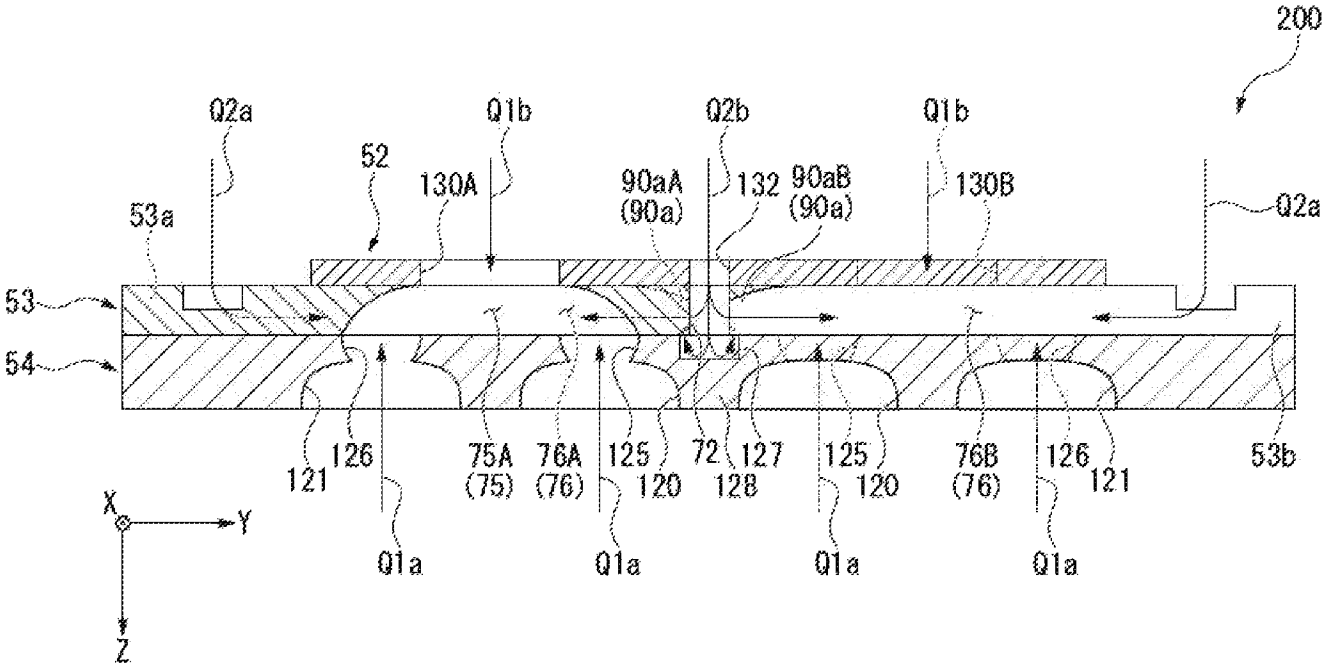
FIG. 10 is an enlarged cross-sectional view of a plate assembly according to the first embodiment.

Then, a method of manufacturing such a head chip 50 as described above will be described. In the following description, when manufacturing the head chip 50 chip by chip will be described as an example for the sake of convenience. FIG. 10 is an enlarged side view of a plate assembly 200.

The method of manufacturing the head chip 50 is provided with a stacking step, a protective film formation step, and a nozzle plate bonding step. It should be noted that it is assumed that the processing necessary in advance of the stacking step has already been performed on each of the plates 51 through 54.

In the stacking step, the actuator plate 53, the cover plate 54, and the intermediate plate 52 are bonded to one another with an adhesive or the like. On this occasion, the actuator plate 53 and the cover plate 54 are bonded to each other so that the ejection channels 75 in the channel columns 61 through 64 are communicated with the corresponding slits 125, 126. Further, the actuator plate 53 and the intermediate plate 52 are bonded to each other so that the ejection channels 75 in the channel columns 61 through 64 are communicated with the corresponding communication holes 130. By the actuator plate 53, the cover plate 54, and the intermediate plate 52 being bonded to one another, the plate assembly 200 is formed. In this state, the ejection channels 75 are communicated with the outside of the ejection channels 75 through the slits 125, 126 and the communication holes 130. In each of the non-ejection channels 76, the penetration part 76*a* is communicated with the outside of the non-ejection channel 76 in the outside areas 81, 86, and the open aperture 90*a* is communicated with the outside of the non-ejection channel 76 through the column separation groove 72 and the second open groove 132.

In the protective film formation step, the first protective film 110 is formed in each of the ejection channels 75, and at the same time, the second protective film 111 is formed on the inner surface of each of the non-ejection channels 76. The protective films 110, 111 are formed by depositing a para-xylylene resin material using, for example, a chemical vapor deposition method (CVD). Specifically, in the state in which the plate assembly 200 is set in a chamber (not shown), a raw material gas to be the formation material of the protective films 110, 111 is introduced. On this occasion, the raw material gas is introduced into the ejection channels 75 through the slits 125, 126 and the communication holes 130. In other words, the raw material gas is introduced from the both end portions in the Y direction of each of the ejection channels 75 through the common ink chambers 120, 121 and the slits 125, 126 (see arrows Q1*a*). The raw material gas is introduced from the central portion in the Y direction of each of the ejection channels 75 through the communication holes 130 (see arrows Q1*b*). By the raw material gas introduced into the ejection channels 75 adhering to the inner surfaces of the ejection channels 75, the first protective films 110 are deposited on the inner surfaces of the ejection channels 75.

Into the non-ejection channels 76, there is introduced the raw material gas through the penetration parts 76*a* and the communication parts 90. In other words, the raw material gas is introduced into the non-ejection channels 76 through the portions (the open apertures 53*a*, 53*b*) opened in the outside areas 81, 86 out of the penetration parts 76*a* (see arrows Q2*a*). The raw material gas enters the second open grooves 132 and the column separation grooves 72, and is then introduced into the non-ejection channels 76 through the open apertures 90*a* (see arrow Q2*b*). Further, the raw material gas having entered the column separation groove 72 enters the communication grooves 127, and is then introduced into the non-ejection channels 76 through the open apertures 90*a* from the reverse surface side of the actuator plate 53. By the raw material gas introduced into the non-ejection channels 76 adhering to the inner surfaces of the non-ejection channels 76, the second protective films 111 are deposited. It should be noted that in the protective film formation step, it is possible for the protective film to be deposited other portions than the inner surfaces of the channels 75, 76 as long as the protective films 110, 111 are formed on at least the inner surfaces of the channels 75, 76.

Subsequently, in the nozzle plate bonding step, the nozzle plate 51 and the actuator plate 53 are bonded to each other so that the nozzle holes 145 through 148 are communicated with the ejection channels 75 of the corresponding channel columns 61 through 64 through the communication holes 130.

Due to the steps described hereinabove, the head chip 50 is manufactured.

It should be noted that the head chip 50 can be manufactured in terms of wafer. When manufacturing the head chips 50 in terms of wafer, an actuator wafer having a plurality of actuator plates 53 connected to each other, a cover wafer having a plurality of cover plates 54 connected to each other, and an intermediate wafer having a plurality of intermediate plates 52 connected to each other are bonded to one another to form a wafer assembly. Subsequently, the protective films 110, 111 are provided to the wafer assembly, and then, the wafer assembly is cut to thereby form a plurality of head chips 50.

As described above, in the present embodiment, there is adopted the configuration in which the projective films 110, 111 are respectively formed on the inner surfaces of the ejection channels 75 and the non-ejection channels 76 in the first channel A column 61, and the inner surfaces of the ejection channels 75 and the non-ejection channels 76 in the first channel B column 62 in the same channel group (e.g., the first channel group 66).

According to this configuration, by the protective films 110, 111 being formed on the inner surfaces of the ejection channels 75 and the non-ejection channels 76, it is possible to prevent the electrodes 95, 97 formed on the inner surfaces of the ejection channels 75 and the non-ejection channels 76 from making contact with the ink. Thus, it is possible to prevent the short circuit of the electrodes 95, 97 caused by the ink, and thus, it is possible to maintain the excellent ejection performance over a long period of time.

In particular, in the present embodiment, in the actuator plate 53, in the both end portions in the Y direction of the non-ejection channels 76A in the first channel A column 61, there are formed the open apertures 53*a*, 90*a*A which communicate the inside and the outside of the non-ejection channels 76A, and at the same time, are capable of introducing the formation material of the second protective films 111 into the non-ejection channels 76A. In contrast, in the actuator plate 53, there is adopted the configuration in which in the both end portions in the Y direction of the non-ejection channels 76B in the first channel B column 62, there are formed the open apertures 53*b*, 90*a*B which communicate the inside and the outside of the non-ejection channels 76B, and at the same time, are capable of introducing the formation material of the second protective films 111 into the non-ejection channels 76B.

According to this configuration, by introducing the formation material of the second protective films 111 into the non-ejection channels 76 through the open apertures 53*a*, 90*a*A and the open apertures 53*b*, 90*a*B, it is possible to effectively form the second protective films 111 also on the inner surfaces of the non-ejection channels 76.

As a result, it is possible to prevent the short circuit or the like of the electrodes formed on the inner surfaces of the non-ejection channels 76 caused by, for example, the ink having entered the non-ejection channels 76.

Moreover, in the present embodiment, the formation material of the first protective films 110 is introduced into the ejection channels 75 through the slits 125, 126 and the communication holes 130, and the formation material of the second protective films 111 is introduced into the non-ejection channels 76 through the open apertures 53*a*, 53*b*, and 90*a*. Thus, it is possible to effectively form the protective films 110, 111 on the inner surfaces of the ejection channels 75 and the inner surfaces of the non-ejection channels 76.

In the present embodiment, there is adopted the configuration in which the actuator plate 53 and the intermediate plate 52 are provided with the column separation grooves 72 and the second open grooves 132 for communicating the open apertures 90*a*A of the non-ejection channels 76A in the first channel A column 61 and the open apertures 90*a*B of the non-ejection channels 76B in the first channel B column 62 with each other.

According to this configuration, the raw material gas of the second protective films 111 is introduced into the non-ejection channels 76 via the open apertures 90*a* from the column separation grooves 72 and the second open grooves 132. Thus, it is possible to efficiently form the second protective films 111 compared to when introducing the formation material of the protective films individually into the non-ejection channels 76 through the respective open apertures 90*a*.

In the present embodiment, there is adopted the configuration in which the cover plate 54 is provided with the communication grooves 127 communicated with the column separation groove 72.

According to this configuration, in the plate assembly 200, since it is possible to reduce the pressure loss in the space connected to the open apertures 90*a*, it is possible to efficiently introduce the raw material gas of the second protective films 111 into the non-ejection channels 76 through the open apertures 90*a*.

In the present embodiment, the width in the X direction in the communication groove 127 is made wider than that of the column separation groove 72, and the communication grooves 127 are communicated with the open apertures 90*a* from the reverse surface side of the actuator plate 53.

According to this configuration, the raw material gas of the second protective film 111 having entered the communication grooves 127 through the column separation grooves 72 is introduced into the non-ejection channels 76 via the open apertures 90*a* from the reverse surface side of the actuator plate 53. Thus, the raw material gas of the second protective films 111 is introduced into the non-ejection channels 76 directly through the column separation grooves 72 or indirectly through the communication grooves 127. As a result, it is possible to efficiently form the second protective films 111 on the inner surfaces of the non-ejection channels 76.

In the present embodiment, there is adopted the configuration in which the beam parts 128 are each disposed between the entrance common ink chambers 120 adjacent to each other in the cover plate 54.

According to this configuration, it becomes easy to ensure the strength of the cover plate 54 with the beam parts 128. Therefore, when bonding the actuator plate 53 and the cover plate 54 to each other, the bonding load can effectively be applied between the actuator plate 53 and the cover plate 54. As a result, it is possible to surely bond the actuator plate 53 and the cover plate 54 to each other to prevent the leakage of the ink through an area between the actuator plate 53 and the cover plate 54.

Further, by providing the beam parts 128 with the communication grooves 127, it becomes easy to ensure the depth of the communication grooves 127. Therefore, it is possible to efficiently introduce the raw material gas of the second protective films 111 into the non-ejection channels 76 through the open apertures 90*a*.

In the present embodiment, the uprise part 76*b* in the first channel A column 61 traverses the column separation groove 72 in the Y direction, and at the same time, a communication portion with the column separation groove 72 constitutes the open aperture 90*a*A, and the uprise part 76*b* in the first channel B column 62 traverses the column separation groove 72 in the Y direction, and at the same time, a communication portion with the column separation groove 72 constitutes the open aperture 90*a*B.

According to this configuration, it is easy to ensure the aperture area of the open aperture compared to when the column separation groove 72 is communicated in the end portion of the uprise part 76*b*. Thus, it is possible to efficiently introduce the raw material gas of the second protective films 111 into the non-ejection channels 76 through the open apertures 90*a*.

In the inkjet head 5 and the printer 1 according to the present embodiment, since the head chip 50 described above is provided, it is possible to prevent the short circuit of the electrodes with the ink, and thus, it is possible to maintain the excellent ejection performance over a long period of time.

Second Embodiment

Figure 11:
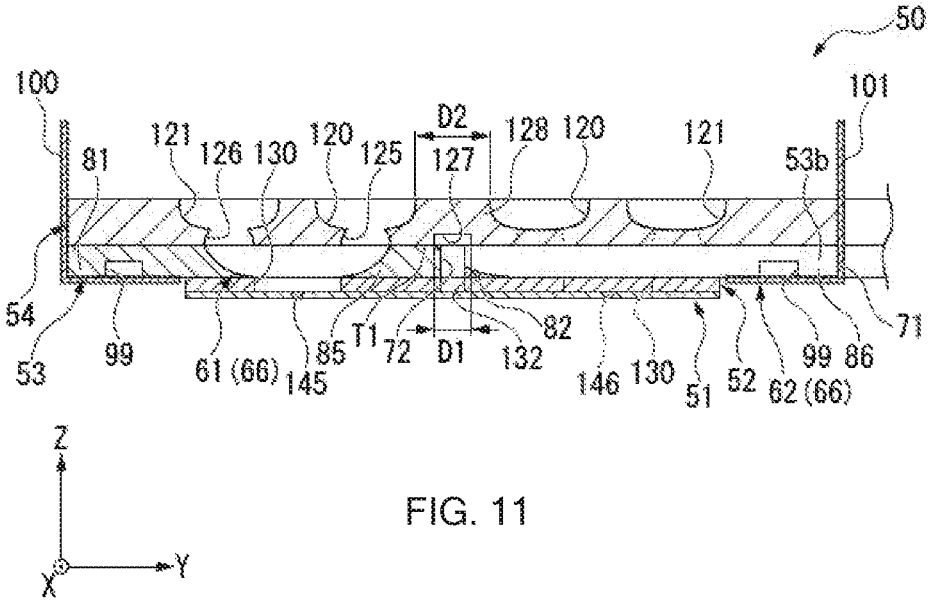
FIG. 11 is an enlarged cross-sectional view of a head chip according to a second embodiment.

In the head chip 50 shown in FIG. 11, the communication grooves 127 are each disposed in the central portion in the Y direction of the beam part 128. A width D1 in the Y direction of the communication groove 127 is narrower than a width D2 in the Y direction of the beam part 128. Therefore, a portion located outside the communication groove 127 on the surface of the beam part 128 functions as a pressure receiving area T1 bonded to the actuator plate 53. It should be noted that a bottom surface of the entrance common ink chamber 120 is located at the reverse surface side of the vertex surface of the communication groove 127. Therefore, the entrance common ink chamber 120 and the communication groove 127 are disposed so as to be shifted in the Z direction from each other (do not overlap each other).

In the present embodiment, in the beam part 128, the portion located at the outer side of the communication groove 127 is provided with the pressure receiving area T1. The pressure receiving area T1 functions as a pressure receiving surface for receiving the load which acts between the actuator plate 53 and the cover plate 54 when bonding the actuator plate 53 and the cover plate 54 to each other. Thus, it is possible to effectively apply the bonding load between the actuator plate 53 and the cover plate 54. As a result, it is possible to more surely bond the actuator plate 53 and the cover plate 54 to each other.

Figure 12:
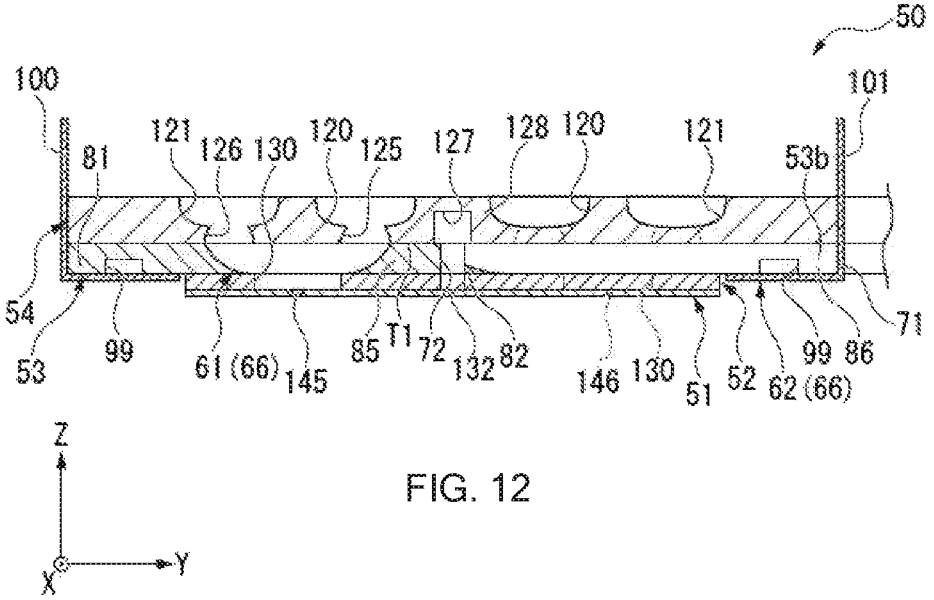
FIG. 12 is an enlarged cross-sectional view of a head chip according to another configuration of the second embodiment.

As shown in FIG. 12, it is possible for the entrance common ink chamber 120 and the communication groove 127 to overlap each other in the Z direction. Thus, it becomes easy to ensure the depth of the communication groove 127, and therefore, it is possible to efficiently introduce the raw material gas of the second protective films 111 into the non-ejection channels 76 through the open apertures 90*a*.

It should be noted that the scope of the present disclosure is not limited to the embodiments described above, but a variety of modifications can be applied within the scope or the spirit of the present disclosure.

For example, in the embodiments described above, the description is presented citing the inkjet printer 1 as an example of the liquid jet recording device, but the liquid jet recording device is not limited to the printer. For example, a facsimile machine, an on-demand printing machine, and so on can also be adopted.

In the embodiments described above, the description is presented citing the configuration (a so-called shuttle machine) in which the inkjet head moves with respect to the recording target medium when performing printing as an example, but this configuration is not a limitation. The configuration related to the present disclosure can be adopted as the configuration (a so-called stationary head machine) in which the recording target medium is moved with respect to the inkjet head in the state in which the inkjet head is fixed.

In the embodiments described above, there is described when the recording target medium P is paper, but this configuration is not a limitation. The recording target medium P is not limited to paper, but can also be a metal material or a resin material, and can also be food or the like.

In the embodiments described above, there is described the configuration in which the liquid jet head is installed in the liquid jet recording device, but this configuration is not a limitation. Specifically, the liquid to be jetted from the liquid jet head is not limited to what is landed on the recording target medium, but can also be, for example, a medical solution to be blended during a dispensing process, a food additive such as seasoning or a spice to be added to food, or fragrance to be sprayed in the air.

In the embodiments described above, there is described the configuration in which the Z direction coincides with the gravitational direction, but this configuration is not a limitation, and it is also possible to set the Z direction along the horizontal direction.

In the embodiments described above, there is adopted the configuration in which the non-ejection channels 76 in the first channel A column 61 and the non-ejection channels 76 in the first channel B column 62 open in the common column separation groove 72 in the first channel A column 61 and the first channel B column 62 (or the second channel A column 63 and the second channel B column 64). It should be noted that it is possible for the non-ejection channels 76 in the first channel A column 61 and the non-ejection channels 76 in the first channel B column 62 to communicate the inside and the outside of the non-ejection channels 76 with each other through the respective grooves separated from each other.

In the embodiments described above, there is described the configuration in which the width of the communication groove 127 is wider than the width of the column separation groove 72 in the cover plate 54, but the width of the communication groove 127 can be wider or narrower than the width of the column separation groove 72. Further, it is possible for the cover plate 54 to have a configuration not provided with the communication grooves 127.

In the embodiments described above, the non-ejection channels 76 can be communicated through other portions than the open apertures 53*a*, 90*a* as long as the non-ejection channels are communicated with the outside in the both end portions.

In the embodiments described above, the description is presented citing the protective films for protecting the electrodes as an example, but it is possible to form the protective film irrespective of the presence or absence of the electrodes.

Figure 13:
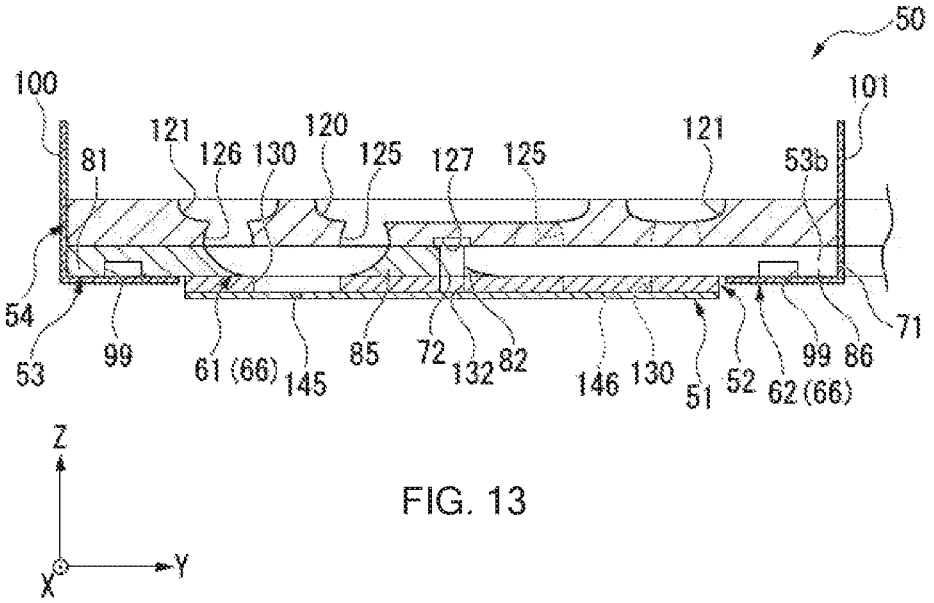
FIG. 13 is an enlarged cross-sectional view of a head chip according to a modified example.

In the embodiments described above, there is described the configuration in which the entrance common ink chamber 120 is disposed for each of the channel columns, but this configuration is not a limitation. For example, as shown in FIG. 13, it is possible to share the single entrance common ink chamber 120 with respect to the channel columns 61, 62 adjacent to each other. In this case, in the entrance common ink chamber 120, there open the entrance slits 125 communicated with the ejection channels 75A in one channel column 61 and the entrance slits 125 communicated with the ejection channels 75B in another channel column 62. In such a configuration, it is possible to form the communication groove 127 at the position (the portion located at the −Z side of the entrance common ink chamber 120) overlapping the column separation groove 72 in the plan view on the surface of the cover plate 54.

Besides the above, it is arbitrarily possible to replace the constituents in the embodiments described above with known constituents within the scope or the spirit of the present disclosure, and it is also possible to arbitrarily combine the modified examples described above.

What is claimed is:

1. A head chip comprising:

an actuator plate having a first channel area and a second channel area disposed side by side in a first direction, a first jet channel extending in the first direction and a first non-jet channel extending in the first direction being arranged in a second direction crossing the first direction in the first channel area, and a second jet channel extending in the first direction and a second non-jet channel extending in the first direction being arranged in the second direction in the second channel area;

a cover plate which has a first liquid flow channel communicated with the first jet channel, and a second liquid flow channel communicated with the second jet channel, and which is stacked on the actuator plate; and a communication plate which has a first communication hole communicated with the first jet channel in a central portion in the first direction, and a second communication hole communicated with the second jet channel in a central portion in the first direction, and which is stacked on the actuator plate at an opposite side to the cover plate, wherein protective films are formed respectively on an inner surface of the first jet channel, an inner surface of the first non-jet channel, an inner surface of the second jet channel, and an inner surface of the second non-jet channel, in the actuator plate, first open apertures which communicate an inside and an outside of the first non-jet channel with each other are formed in both end portions of the first non-jet channel in the first direction, and in the actuator plate, second open apertures which communicate an inside and an outside of the second non-jet channel with each other are formed in both end portions of the second non-jet channel in the first direction.

2. The head chip according to claim 1, wherein the first open apertures include a first inside open aperture located in the end portion of the first non-jet channel at the second channel area side in the first direction, and a first outside open aperture located in the end portion of the first non-jet channel at an opposite side to the second channel area side in the first direction, the second open apertures include a second inside open aperture located in the end portion of the second non-jet channel at the first channel area side in the first direction, and a second outside open aperture located in the end portion of the second non-jet channel at an opposite side to the first channel area side in the first direction, and a common groove which extends in the second direction, and which is communicated with the first inside open apertures in a plurality of the first non-jet channels, and the second inside open apertures of a plurality of the second non-jet channels is formed in a boundary portion located between the first channel area and the second channel area in the first direction in the actuator plate and the communication plate.

3. The head chip according to claim 2, wherein the cover plate is provided with a communication groove communicated with the common groove.

4. The head chip according to claim 3, wherein the communication groove is made larger in width in the first direction than the common groove, and the communication groove is communicated with the first inside open aperture and the second inside open aperture from an opposite side to the communication plate with respect to the actuator plate.

5. The head chip according to claim 3, wherein the cover plate includes a first common flow channel communicated with a plurality of the first liquid flow channels in a lump, and a second common flow channel communicated with a plurality of the second liquid flow channels in a lump, and a portion located between the first liquid flow channel and the second common flow channel in the cover plate constitutes a beam part which partitions the first common flow channel and the second common flow channel from each other, and which extends in the second direction.

6. The head chip according to claim 5, wherein the communication groove is provided to the beam part, and a width in the first direction of the communication groove is narrower than a width of the beam part in the first direction.

7. The head chip according to claim 6, wherein the communication groove overlaps the first common flow channel and the second common flow channel in a stacking direction in which the actuator plate and the cover plate are stacked on one another.

8. The head chip according to claim 2, wherein the first non-jet channel includes a first extension part extending in the first direction, and a first uprise part having a groove depth gradually decreasing in a direction from the first extension part toward the second channel area in the first direction, the second non-jet channel includes a second extension part extending in the first direction, and a second uprise part having a groove depth gradually decreasing in a direction from the second extension part toward the first channel area in the first direction, the first uprise part traverses the common groove in the first direction, and has a communication portion with the common groove constituting the first inside open aperture, and the second uprise part traverses the common groove in the first direction, and has a communication portion with the common groove constituting the second inside open aperture.

9. A liquid jet head comprising the head chip according to claim 1.

10. A liquid jet recording device comprising the liquid jet head according to claim 9.

11. A method of manufacturing a head chip including an actuator plate in which a jet channel extending in a first direction and a non-jet channel extending in the first direction are arranged in a second direction crossing the first direction, a cover plate which includes a liquid flow channel communicated with the jet channel, and which is stacked on the actuator plate, and a communication plate which has a communication hole communicated with the jet channel in a central portion in the first direction, and which is stacked on the actuator plate at an opposite side to the cover plate, in the actuator plate, open apertures which communicate an inside and an outside of the non-jet channel with each other being formed in both end portions of the non-jet channel in the first direction, the method comprising a protective film formation step of forming protective films on an inner surface of the jet channel and an inner surface of the non-jet channel, wherein in the protective film formation step, a formation material of the protective films is introduced into the jet channel through the liquid flow channel and the communication hole, and the formation material of the protective films is introduced into the non-jet channel through the open apertures.

* * * * *